US006684051B2

(12) United States Patent
Miyamoto et al.

(10) Patent No.: US 6,684,051 B2
(45) Date of Patent: Jan. 27, 2004

(54) PRINT SYSTEM AND REGISTRATION CONTROL METHOD AT PRINT START TIME OF THE PRINT SYSTEM

(75) Inventors: Atsushi Miyamoto, Ibaraki (JP); Souichi Nakazawa, Ibaraki (JP); Masahiro Mizuno, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/200,132

(22) Filed: Jul. 23, 2002

(65) Prior Publication Data

US 2003/0039496 A1 Feb. 27, 2003

(30) Foreign Application Priority Data

Aug. 24, 2001 (JP) ..... P.2001-254188
Apr. 26, 2002 (JP) ..... P.2002-126294

(51) Int. Cl.[7] ..... G03G 15/00
(52) U.S. Cl. ..... 399/384; 400/582
(58) Field of Search ..... 399/384; 400/582

(56) References Cited

U.S. PATENT DOCUMENTS 4,011,975 A * 3/1977 Brown, Jr. ..... 226/2
2001/0024589 A1 * 9/2001 Ohba et al. ..... 400/582
2002/0081132 A1 * 6/2002 Miyamoto et al. ..... 399/384

FOREIGN PATENT DOCUMENTS

JP 61-282245 * 12/1986
JP 9-300597 * 11/1997

* cited by examiner

*Primary Examiner*—Quana M. Grainger
(74) *Attorney, Agent, or Firm*—McGinn & Gibb, PLLC

(57) ABSTRACT

A print system having a first printer and a second printer being placed at the stage following the first printer, the first printer having a mark formation section for forming a register mark at a predetermined location of a web and the second printer having mark detector for detecting the register mark and a buffer plate being placed so that it can be advanced to and retreated from a web transport passage for giving a constant tension to the web comprises a controller for setting the buffer plate to a predetermined position during the period until the register mark is transported at a constant distance after passing through the mark detector.

14 Claims, 5 Drawing Sheets

PRINT SYSTEM AND REGISTRATION CONTROL METHOD AT PRINT START TIME OF THE PRINT SYSTEM

BACKGROUND OF THE INVENTION

1. Field of the Invention

This invention relates to a print system for forming an image on a web using a plurality of printers and in particular to registration control of the print start position in the second or later installed printer.

2. Description of the Related Art

As a print system for forming an image, etc., on both sides of a web typified by belt-like paper continuous in the length direction, a print system is proposed and is commercially practical wherein two printers are placed in series and the printer at the preceding stage (first printer) prints on the first side (surface) of a web and the web ejected from the first printer is reversed to the back by a reversing unit and then is fed into the following printer (second printer) for printing on the second side (back) of the web.

Two types of webs used with such a print system, continuous forms paper comprising sprocket holes in both margins and a web with no sprocket holes, are available, and a print system compatible with both types of webs is becoming pervasive.

In this kind of print system, hitherto the worker has performed work of registering the web placed in the second printer at the print start position by setting a register mark, etc., printed at web perforation or the page top position to a registration gage placed in the printer by visually check.

By the way, generally the printer for handling this kind of web is provided with a tension giving mechanism for giving constant tension to the web in a transport passage of the web. Various configurations of the tension giving mechanism are also proposed. As one of them, hitherto the configuration wherein a plate-like member supported rockably, which will be hereinafter referred to as buffer plate, is placed on the web transport passage and the buffer plate is urged to one side of the web so as to give constant tension to the web is known.

Hitherto, in a print system using a printer having such a buffer plate, the position of the buffer plate (rotation amount) at the completion time of registration of the print start position has not been guaranteed. If print is started in a state in which the buffer plate is positioned above or below the appropriate position, the printer attempts to correct the position of the buffer plate to the appropriate position (neutral position) and executes speed control of each transport mechanism and thus the image at the print start stage may be disarranged.

Thus, hitherto, after completion of registration, the worker has needed to check the position of the buffer plate and adjust to the position of the buffer plate to the appropriate position before starting print; intricate work has been indispensable.

SUMMARY OF THE INVENTION

It is an object of the invention to provide a print system and a registration control method at the print start time of the print system capable of automatically performing web print start registration and buffer plate registration and printing an image precisely starting at the first print page.

To the end, according to the invention, there is provided a print system having a first printer for forming an image on a first side of a web and a second printer being placed at the stage following the first printer for forming an image on a second side of the web, the first printer having at least mark formation means for forming a register mark at a predetermined location of the web and the second printer having at least mark detection means for detecting the register mark and a buffer plate being placed so that it can be advanced to and retreated from a web transport passage for giving a constant tension to the web, characterized by control means for setting the buffer plate to a predetermined position during the period until the register mark is transported at a constant distance after passing through the mark detection means.

DETAILED DESCRIPTION OF THE PREFERRED EMBODIMENTS

Figure 1:
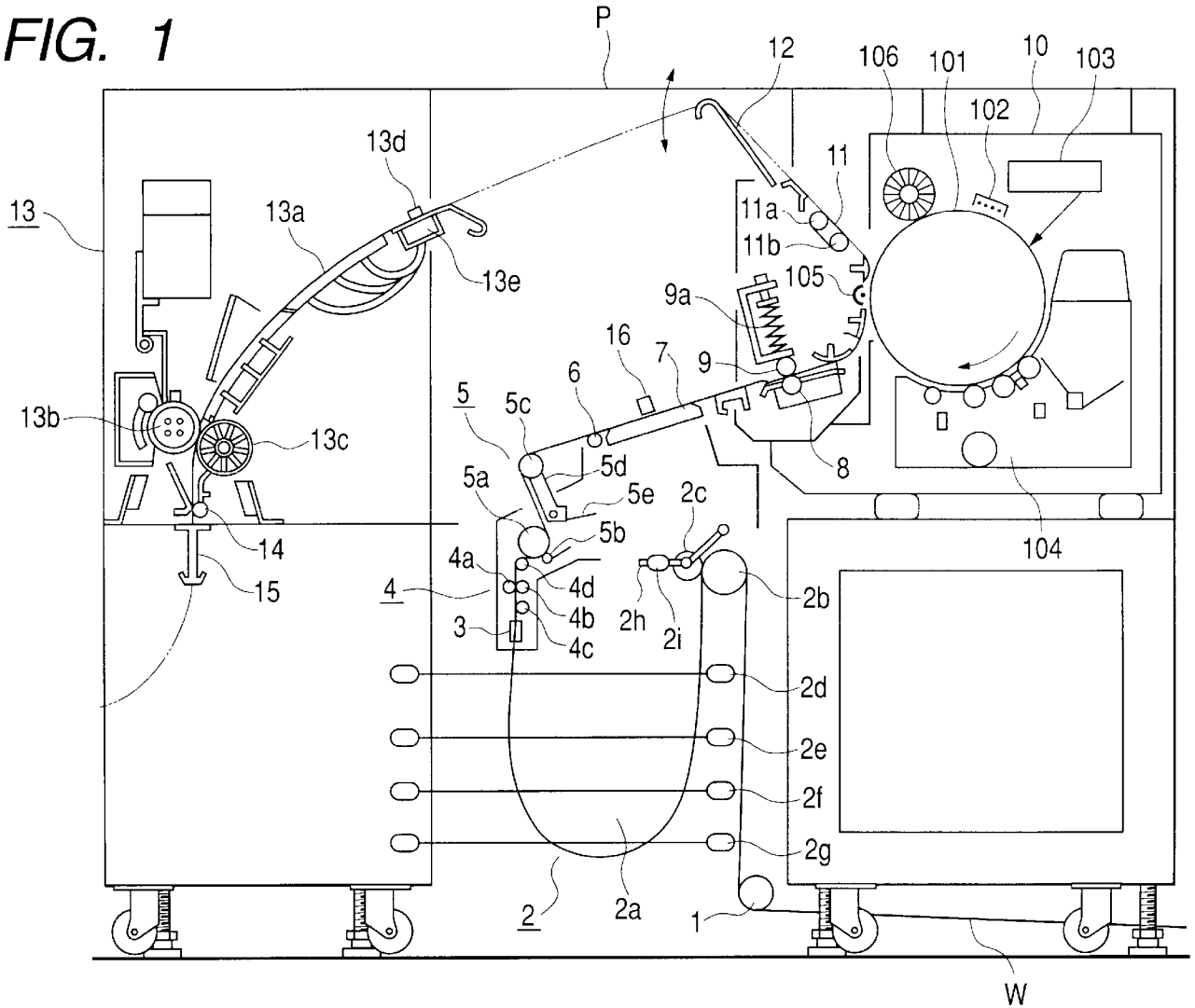
FIG. 1 is a schematic diagram of the configuration of a printer.

Referring now to the accompanying drawings, there are shown preferred embodiments of the invention. To begin with, one embodiment of an electrophotographic printer applied to a print system of the invention will be discussed with reference to FIG. 1. In the figure, W denotes a web and usually paper is used. The web W is fed into a printer P from a paper feed unit (not shown) and is guided by a guide roller 1 and is transported to a web buffer mechanism 2.

The web buffer mechanism 2 comprises a storage section 2*a* for temporarily storing the transported web W, a plurality of optical sensors 2*d*, 2*e*, 2*f*, and 2*g* for detecting the deflection amount of the web W (buffer amount), and a pair of rollers 2*b* and 2*c* placed upstream in the web transport direction. The roller 2*c* is provided with an adjustment mechanism for adjusting the press pressure against the roller 2*b*.

In the embodiment, a shaft 2*h* projected from one end of the roller 2*c* is provided with a weight 2*i* slidably and the position of the weight 2*i* is changed, whereby the press pressure of the roller 2*c* against the roller 2*d* is adjusted as the principle of the level. The web buffer mechanism 2 itself is not directly related to the invention and therefore will not be discussed; it is describe in detail in Japanese Patent Application No. 2000-389699.

The web W passing through a guide member 3 is next fed into a foreign substance removal mechanism 4. The foreign substance removal mechanism 4 comprises shafts 4*a*, 4*b*, 4*c*, and 4*d* fixedly placed. The shafts 4*a* and 4*b* are placed with a preset extremely narrow spacing for blocking entry of a foreign material.

The web W is further transported into a tension giving mechanism 5. The tension giving mechanism 5 is made up of a drum 5*a* having no drive source, a roller 5*b* pressed against the drum 5*a*, and a drum 5*c* supported movably on a web transport passage. The drum 5 is fixed to a free end of an arm 5*d* supported rotatably and is urged to one side of the web W by a spring 5*e*. The tension giving mechanism 5 is provided, whereby the tension of the web W is kept constant.

Further, the web W is fed through a guide shaft 6 and a guide plate 7 into a print photo section 10 by transport rollers 8 and 9. In the embodiment, a print photo apparatus using an electrophotographic record system is used as the print photo section 10, but the invention is not limited to the record apparatus using the electrophotographic record system. When a photoconductor drum 101 exemplified as an image support starts to rotate, a high voltage is applied to a corona charger 102 and the surface of the photoconductor drum 101 is uniformly charged, for example, positively. Light output from a light source 103 implemented as a semiconductor laser, a light emitting diode, etc., is applied onto the photoconductor drum 101 for forming an electrostatic latent image on the photoconductor drum 101. When the photoconductor drum area holding the electrostatic latent image arrives at a position opposed to a developing unit 104, a developer is supplied to the electrostatic latent image and a toner image is formed on the photoconductor drum 101.

The toner image formed on the photoconductor drum 101 is sucked onto the web W by the action of a transfer device 105 for giving charges of the opposite polarity to that of the toner image to the rear of the web W. The area passing through the transfer position of the photoconductor drum 101 is cleaned with a cleaning unit 106 for the next print operation.

The web W onto which the toner image is transferred from the print photo section 10 as described above is transported to the following stage on the transfer belt 11. The transport roller 8 is provided as a drive roller having a drive source and is driven by a motor described later. The transport roller 9 is provided as a driven roller pressed against the transport roller 8 via the web W by an elastic force of a spring 9*a*. The transfer belt 11 is placed on a drive roller 11*a* and a driven roller 11*b* for support and comprises a suction unit (not shown) for transporting the web W with the rear of thereof sucked onto the transfer belt 11.

The web W sent out from the transfer belt 11 is transported through a buffer plate 12 to a fuser 13. The web W arriving at the fuser 13 is preheated by a preheater 13*a* and then is transported while it is heated and pressurized in a nip part formed by a pair of fixing rollers of a heating roller 13*b* and a pressurizing roller 13*c*, and the toner image is fused onto the web W.

The web W sent out by the heating roller 13*b* and the pressurizing roller 13*c* is through a delivery roller 14 and usually is folded alternately by the swing operation of a swing fin 15 and is folded and stacked in the printer P. In contrast, in a print system comprising a second printer placed at the stage following the first printer P, the web sent out by the heating roller 13*b* and the pressurizing roller 13*c* is ejected through the delivery roller 14 to the outside of the printer P as indicated by the dashed line in FIG. 1 and is transported to the second printer (not shown).

Numeral 13*d* denotes a sensor for detecting meandering of the web W and numeral 13*e* denotes a suction mechanism for regulating the position of the web W so as to keep the web W and the preheater 13*a* in contact with each other by air suction and not to shift the position of the web W at non-print time. Numeral 16 denotes mark detection means (mark sensor) for detecting a register mark formed on the web W.

The mark sensor 16 is indispensable particularly in the second printer placed at the following stage. When an image is printed on the surface of the web W on the first printer at the preceding stage, a register mark is printed at the page top end position, for example. The second printer at the following stage detects the register mark and controls so that the image to be printed on the back of the web W and the image printed on the surface of the web on the first printer can be registered precisely.

Figure 2:
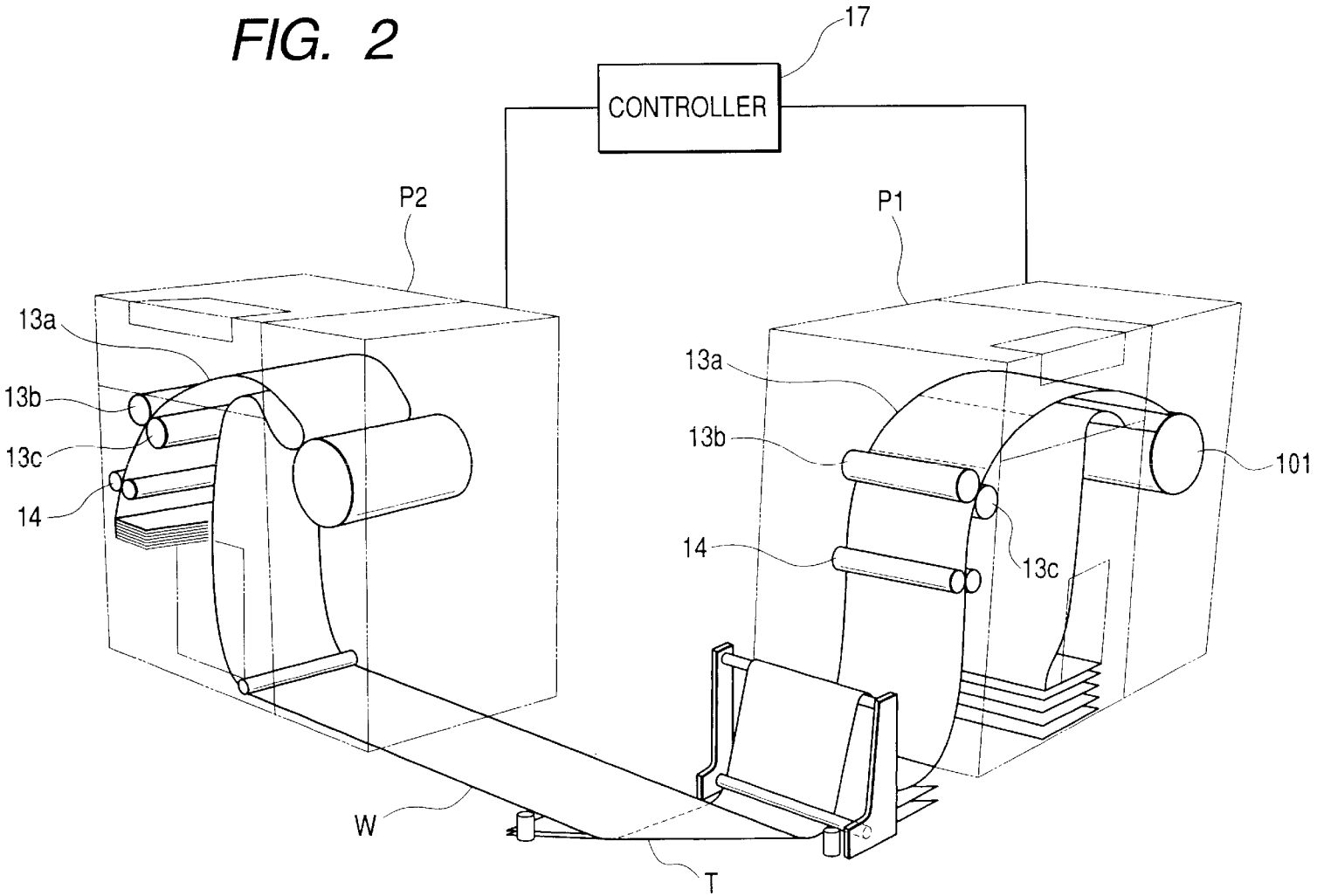
FIG. 2 is a schematic diagram of the configuration of a print system.

FIG. 2 shows one embodiment of the general configuration of a double-sided print system according to the invention. The print system is made up of two printers P1 and P2 each having the configuration previously described with reference to FIG. 1 and a controller 17 connected to both the printers. The web W sent out from the first printer P1 is reversed to the back by a reversing unit T and then is fed into the second printer P2 for forming an image also on the second side of the web W.

Figure 3:
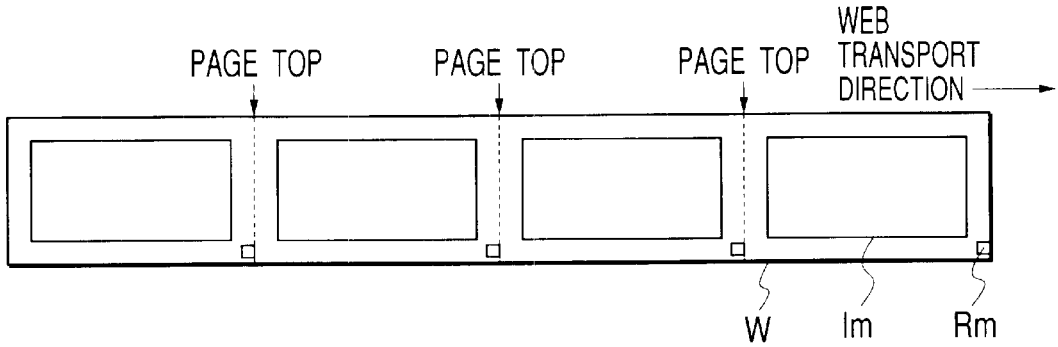
FIG. 3 is a schematic representation to show the relationship between a web and toner marks.

On the first printer P1, an image Im based on print data is printed as shown in FIG. 3 on the web W and a register mark (toner mark) Rm is printed at the top end of each page. Means for forming register marks may be the apparatus for forming the image Im or may be a separate apparatus. In the embodiment, image formation means is also used as the means for forming register marks and register marks are formed together when the image Im is formed on the photoconductor drum 101.

The web W ejected from the first printer P1 is reversed to the back by the reversing unit T and then is fed into the second printer P2. As the web W is reversed to the back by the reversing unit T, the web side (first side) holding the toner mark Rm is opposed to the detection face of the mark sensor 16 and the web side in a blank paper state (second side) is opposed to the surface of the photoconductor drum 101.

Next, print start registration control will be discussed with reference to FIGS. 4, 5, 6, and 7. The print start registration control described below is performed in a state in which the heating roller 13*b* and the pressurizing roller 13*c* are brought away from each other for releasing the press contact therebetween. The web W with the toner mark Rm as a register mark printed at the top position of each page by the first printer P1 is placed in the second printer P2 so that the register mark Rm on the top page comes before the mark sensor 16.

As a trigger for starting print start registration, a mark set switch (not shown) is pressed. Accordingly, first the suction mechanism 13*e* is placed in a non-suction state and the restraining state of the web W is released. Subsequently, driving a puller mechanism 14 forming a part of web transport means is started, whereby the buffer plate 12 receives a constant tension in the web transport direction from the puller mechanism 14. Subsequently, web transport for detecting the register mark Rm representing the page top is started.

Since the suction mechanism 13*e* is in the non-suction state and the puller mechanism 14 is driven, the web W is sent out to the outside of the cabinet as the web W is transported. The printer monitors a signal of the mark sensor 16 while the web W is being transported, and stops monitoring the signal of the mark sensor 16 upon detection of the register mark Rm of the page top. Subsequently, the printer makes a transition to monitoring a web transport distance $L_{PF}$ from the point in time when the register mark Rm of the page top is detected and the angle of the buffer plate 12.

Figure 4:
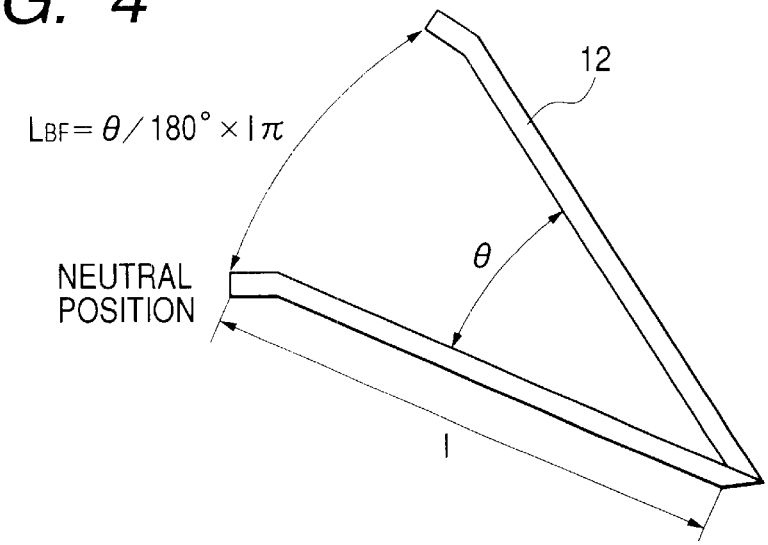
FIG. 4 is a schematic representation to show the relationship between a buffer plate rotation position and a web transfer amount.

Here, assume that the difference between a predetermined buffer plate angle to be controlled, which will be hereinafter referred to as neutral position, and the buffer plate angle at the point in time is θ, as shown in FIG. 4. Web transport amount $L_{BF}$ to set the buffer plate to the neutral position is calculated as $L_{BF}=\theta/180°\times l\pi$ assuming that the length of the buffer plate 12 is l.

Figure 5:
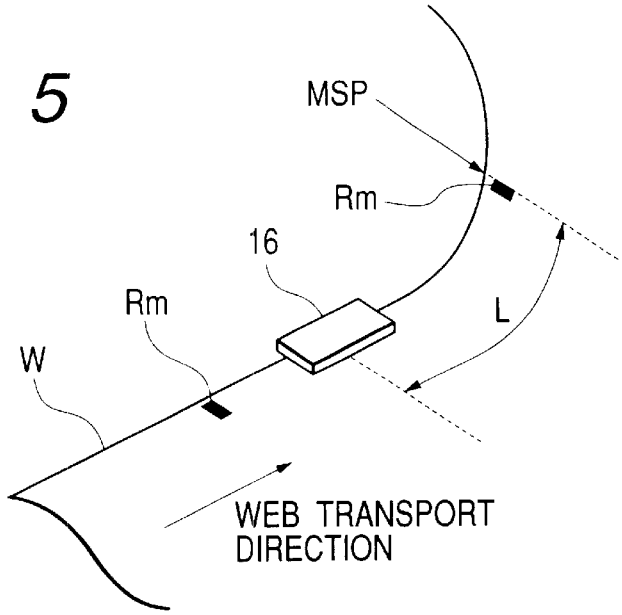
FIG. 5 is a schematic representation to show the relationship between a mark sensor and a mark set position.
Figure 6:
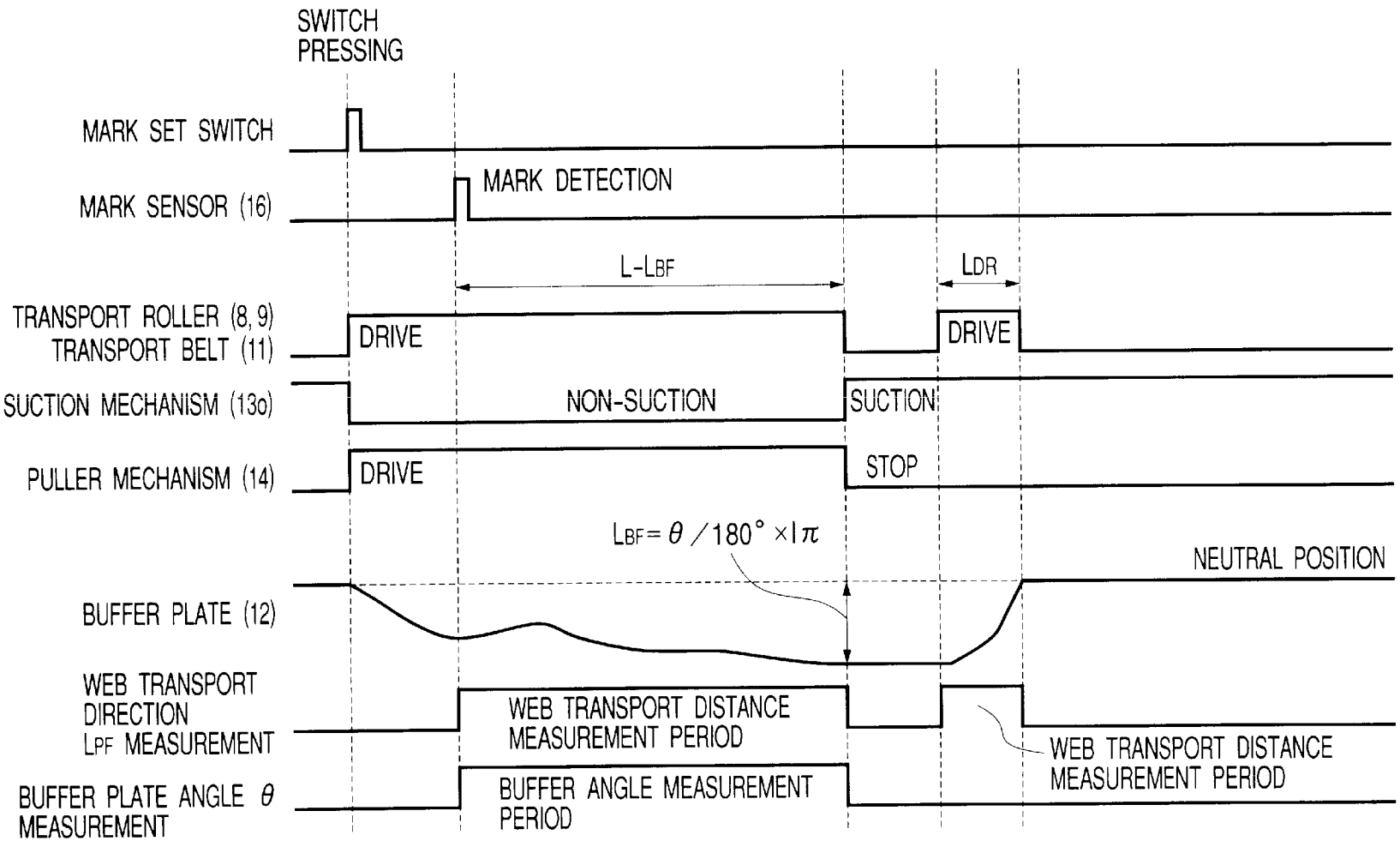
FIG. 6 is a timing chart to show an example of print start registration control.
Figure 7:
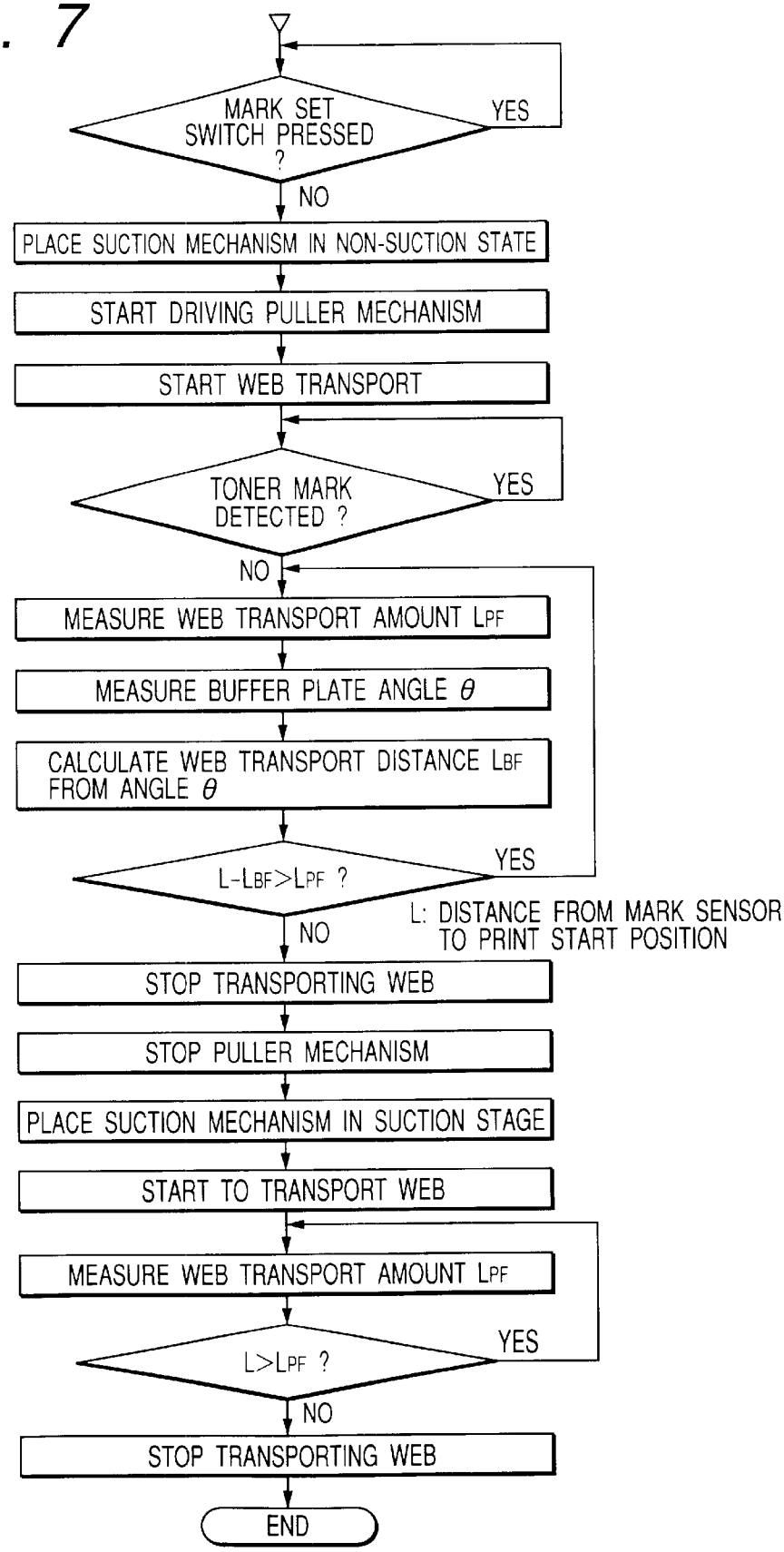
FIG. 7 is a flowchart to show an example of print start registration control.

Assuming that the distance from the mark sensor 16 to a predetermined print start position, which will be hereinafter described as mark set position MSP, is L, as, shown in FIG. 5, the printer temporarily stops the web transport when the web transport distance L satisfies the condition $L-L_{BF}\leqq L_{PF}$.

After the web transport is temporarily stopped, the suction mechanism 13*e* is placed in a suction state for restraining the web W. Subsequently, driving the puller mechanism 14 is stopped. Again the web W is transported for the purposes of setting the register mark Rm to the mark set position MSP and setting the buffer plate 12 to the neutral position.

Here, since the suction mechanism 13*e* is in the suction state and the puller mechanism 14 stops, if the web W is transported, it is not sent out to the outside of the cabinet and slackens between the web transport means 11 and the fuser 13 and the slack is absorbed by the buffer plate 12, whereby the angle of the buffer plate 12 changes. Therefore, the web W is transported by the distance $L_{BF}$, whereby the buffer plate 12 is set to the neutral position. The print start registration operation is now complete.

The description has been given based on the print system comprising the reversing unit for reversing the web W to the back (surface), placed between the first and second printers, but the invention can also be applied to a print system using no reversing unit. In this case, an image formed by the first printer and an image formed by the second printer are formed on one side of the web. At this time, if the mark sensor is installed so as to be opposed to the web side opposite to the position shown in FIG. 1, the toner mark formed in the first printer can be opposed to the mark sensor, needless to say.

As described above, according to the invention, there can be provided the print system and the registration control method at the print start time of the print system capable of automatically performing web print start registration and buffer plate registration and printing an image precisely starting at the first print page.

What is claimed is:

1. A print system comprising:

a first printer for forming an image on a first side of a web;

a second printer being placed at the stage following the first printer for forming an image on a second side of the web, the first printer having at least mark formation means for forming a register mark at a predetermined location of the web and the second printer having at least a mark detector for detecting the register mark and a buffer plate being placed so that it can be advanced to and retreated from a web transport passage for giving a constant tension to the web; and a controller for setting the buffer plate to a predetermined position during the period until the register mark is transported at a constant distance after passing through the mark detector.

2. The print system as claimed in claim 1 wherein said control means sets the buffer plate to a neutral position during the period until the register mark is transported at a constant distance after passing through the mark detector.

3. The print system as claimed in claim 1, wherein the second printer comprises at least a storage section for storing a web transport distance in an arbitrary time period and web transport section for arbitrarily controlling start and stop of web transport and starts and stops web transport in response to the position of the buffer plate and the web transport distance.

4. A print system comprising:

a first printer for forming a first image on a web;

a second printer being placed at the stage following the first printer for forming a second image on the web, the first printer having at least a mark formation section for forming a register mark at a predetermined location of the web and the second printer having at least a mark detector for detecting the register mark and a buffer plate being placed so that it can be advanced to and retreated from a web transport passage for giving a constant tension to the web; and a controller for setting the buffer plate to a predetermined position during the period until the register mark is transported at a constant distance after passing through the mark detector.

5. The print system as claimed in claim 4 wherein said controller sets the buffer plate to a neutral position during the period until the register mark is transported at a constant distance after passing through the mark detector.

6. The print system as claimed in claim 4, wherein the second printer comprises at least a storage section for storing a web transport distance in an arbitrary time period and web transport section for arbitrarily controlling start and stop of web transport and starts and stops web transport in response to the position of the buffer plate and the web transport distance.

7. A print system comprising:

a first printer for forming an image on a first side of a web;

a second printer being placed at the stage following the first printer for forming an image on a second side of the web, the first printer having at least web transport section for transporting the web and mark formation section for forming a register mark at a predetermined location of the web and the second printer having at least a web transport section for transporting the web, a mark detection section for detecting the register mark, a buffer plate being placed so that it can be advanced to and retreated from a web transport passage for giving a constant tension to the web, a position detector for detecting a position of the buffer plate, and a suction section for air-sucking the web for regulating the position of the web; and a controller for controlling driving the web transport section and the suction section so that the buffer plate is positioned at a neutral position during the period until the register mark is transported at a constant distance after passing through the mark detector.

8. The print system as claimed in claim 7, wherein the second printer comprises at least a storage section for storing a web transport distance in an arbitrary time period and web transport section for arbitrarily controlling start and stop of web transport and starts and stops web transport in response to the position of the buffer plate and the web transport distance.

9. A print system having a first printer for forming a first image on a web;

a second printer being placed at the stage following the first printer for forming a second image on the web, the first printer having at least a web transport section for transporting the web and a mark formation section for forming a register mark at a predetermined location of the web and the second printer having at least a web transport section for transporting the web, a mark detector for detecting the register mark, a buffer plate being placed so that it can be advanced to and retreated from a web transport passage for giving a constant tension to the web, a position detector for detecting a position of the buffer plate, and a suction section for air-sucking the web for regulating the position of the web; and a controller for controlling driving the web transport section and the suction section so that the buffer plate is positioned at a neutral position during the period until the register mark is transported at a constant distance after passing through the mark detector.

10. The print system as claimed in claim 6, wherein the second printer comprises at least a storage section for storing a web transport distance in an arbitrary time period and web transport section for arbitrarily controlling start and stop of web transport and starts and stops web transport in response to the position of the buffer plate and the web transport distance.

11. A registration control method at print start time of a print system having a first printer for forming an image on a first side of a web and a second printer being placed at the stage following the first printer for forming an image on a second side of the web, the first printer having at least a mark formation section for forming a register mark at a predetermined location of the web and the second printer having at least a mark detector for detecting the register mark and a buffer plate being placed so that it can be advanced to and retreated from a web transport passage for giving a constant tension to the web, said method comprising the step of:

setting the buffer plate to a predetermined position during the period until the register mark is transported at a constant distance after passing through the mark detector.

12. The registration control method as claimed in claim 11 comprising the setting step sets the buffer plate to a neutral position during the period until the register mark is transported at a constant distance after passing through the mark detector.

13. A registration control method at print start time of a print system having a first printer for forming a first image on a web and a second printer being placed at the stage following the first printer for forming a second image on the web, the first printer having at least mark formation section for forming a register mark at a predetermined location of the web and the second printer having at least mark detector for detecting the register mark and a buffer plate being placed so that it can be advanced to and retreated from a web transport passage for giving a constant tension to the web, said method comprising the step of:

setting the buffer plate to a predetermined position during the period until the register mark is transported at a constant distance after passing through the mark detector.

14. The registration control method as claimed in claim 13 wherein the setting step sets the buffer plate to a neutral position during the period until the register mark is transported at a constant distance after passing through the mark detector.

* * * * *